US005957424A

United States Patent [19]

Krinner

[11] Patent Number: 5,957,424

[45] Date of Patent: Sep. 28, 1999

[54] DEVICE FOR THE VERTICAL ARRANGEMENT OF A POLE OR POST-LIKE OBJECT

[75] Inventor: Klaus Krinner, Blumenthal 9, 94342, Strasskirchen, Germany

[73] Assignee: Klaus Krinner, Strasskirchen, Germany

[21] Appl. No.: 09/011,744

[22] PCT Filed: Aug. 22, 1996

[86] PCT No.: PCT/EP96/03704

§ 371 Date: Jun. 11, 1998

§ 102(e) Date: Jun. 11, 1998

[87] PCT Pub. No.: WO97/08409

PCT Pub. Date: Mar. 6, 1997

[30] Foreign Application Priority Data

Aug. 22, 1996 [DE] Germany ..... 296 06 034 U

[51] Int. Cl.[6] ..... F16M 13/00; F16B 1/00; E04C 3/16

[52] U.S. Cl. ..... 248/514; 248/530; 248/545; 403/181; 52/365

[58] Field of Search ..... 248/514, 520, 248/519, 530, 538, 545; 403/179, 181, 297; 256/DIG. 2; 232/39; 52/301, 365, 376, 726.4, 736.1

[56] References Cited

U.S. PATENT DOCUMENTS 441,072 11/1890 Price ..... 256/DIG. 2
3,033,504 5/1962 Cronin ..... 248/538
3,115,726 12/1963 Sayles ..... 52/155
3,689,017 9/1972 Harvey ..... 248/354 S
5,741,083 4/1998 Schvartz ..... 403/297

FOREIGN PATENT DOCUMENTS 89-030236 3/1989 Germany .

*Primary Examiner*—Derek J. Berger
*Assistant Examiner*—Michael Nornberg
*Attorney, Agent, or Firm*—Jones, Day, Reavis & Pogue

[57] ABSTRACT

A device for the vertical arrangement of a pole or post-like object is disclosed. A securing device is disposed at the ground end and includes a substantially cylindrical, elongated mounting mandrel which projects upwards from the free upper side of the securing device. This mandrel can be inserted into an accommodating bore in the underside of the pole or post-like object. A support plate on which the underside of the pole or post-like object rests, has at least one securing projection that protrudes upwards from the support plate and penetrates the material of the pole or post-like object. The mounting mandrel is substantially thinner than the accommodating bore in the underside of the pole or post-like object such that a play is provided between the outer periphery of the mounting mandrel and the inner circumferential area of the accommodating bore seen substantially over the entire axial extension of the mounting mandrel.

20 Claims, 6 Drawing Sheets

DEVICE FOR THE VERTICAL ARRANGEMENT OF A POLE OR POST-LIKE OBJECT

The invention relates to a device for the vertical arrangement of a pole or post-like object on a securing device disposed at the ground end according to the preamble of claim 1.

BACKGROUND OF THE INVENTION

When erecting poles or posts, for instance when erecting a fence, when putting up a road sign or the like, the problem always arising is to maintain the pole or post in the exactly vertical position, if possible. The vertical locating of a pole or post may be effected, for instance, by checking and possibly correcting the vertical arrangement by means of a water level or a plumb line when a pole or post is secured or anchored in the ground by driving it in or imbedding it in concrete. That is troublesome and time-consuming, because when driving a pole or post into the ground, for instance, the driving operation has to be repeatedly interrupted in order to check and possibly correct the location of the pale or post. When imbedding a pole or post in concrete, the exactly vertical arrangement of the same can be corrected without difficulties before the concrete has set, however means have to be applied to maintain this exactly vertical position until the concrete has set so that this vertical position can no longer be changed by itself; that is, the pole or post has to be laterally supported or braced, for instance.

Apart from driving or digging a pole or post in or else imbedding it in concrete, it is known to use securing devices which can be anchored in the ground which then support the pole or post-like object on their upper free end. The securing device adapted to be anchored in the ground comprises, for example, a worm or screw which is drilled into the ground like a corkscrew, whereupon the pole or post is then screwed to this securing device or inserted into the same. It is further known to integrally form the pole or post-like object and the securing device to be anchored in the ground like a corkscrew so that the pole or post-like object includes at one of its free ends the securing device which is then screwed into the ground and anchored herein. With this method or these possibilities of erecting a pole or post, too, substantially the same problems are arising regarding the vertical arrangement of the pole or post as when driving the latter in or imbedding it in concrete. Instead of the driving operation the screwing of the securing device into the ground must be repeatedly interrupted in order to secure the later vertical position of the pole or post by appropriate measuring and possibly correcting steps.

DESCRIPTION OF RELATED ART

DE-GM 93 13 260 suggests an adjusting device provided between a securing device adapted to be anchored in the ground, for instance a ground screw, and the pole or post-like object to be secured hereto. In accordance with an embodiment of DE-GM 93 13 260, this adjusting device substantially comprises a cylindrical elongated mounting mandrel projecting upwards from the free upper side of the securing device and being adapted to be inserted into an accommodating bore in the underside of the pole or post-like object. The axial extension of the mounting mandrel and the depth of the accommodating bore are selected such that the former is somewhat longer than is the depth of the latter so that, when slipping the pole or post-like object onto the mounting mandrel, the free end of the latter rests on the bottom of the accommodating bore. The pole or post-like object is now maintained in an exactly vertical position—possibly with the aid of a plumb line or a water level—, whereupon one or several strokes are applied to the upper end of the object so that the free end of the mounting mandrel penetrates the bottom of the blind bore and thus the object is fixed in its exactly vertical position vis-à-vis the securing device.

The subject-matter of DE-GM 93 13 260 has widely proved successful in practice; nevertheless, it has the minor defect that due to the narrow positive-locking surrounding of the journal by the material of the pole or post, the pole shoe itself must be anchored exactly vertically in the ground so as to ensure a vertical position of the pole or post held hereby. Although DE-GM 93 13 260 in further configurations suggests adjusting devices between the post and the securing device to be able to maintain the post in an exactly vertical position, even if the securing device is mounted in the ground obliquely or out-of-perpendicular, these adjusting devices are rather complicated and thus expensive, however.

From DE-GM 89 03 236 a generic device in the form of a post shoe for wooden designs and especially for wooden designs of playground climbing frames has become known. This known device comprises a securing device disposed at the ground end in the form of an anchoring member to be anchored in the ground or in a foundation and a support member arranged hereon and adapted to be positively engaged with the pole or post. The support member is a vertically extending journal which is held in a recess in the underside of the post such that the post closely fits around the journal, i.e. in a practically positive-locking manner. Furthermore there is provided a resting surface or support plate for the post from whose plane the journal extends upwards and on which the underside of the post rests. The support plate further has a circumferential toothed ring which digs into the front by applying strokes onto the upper end of the post and provides a fixing of the position in the transverse direction. As an additional protection against removal or detachment a transversely extending pin is provided which horizontally passes both through the material of the post and through the material of the journal. By the post shoe according to DE-GM 89 03 236 the post or pole is supported at a particular distance above the ground so that it is better protected against weather influences due to rain, snow or the like as well as against vermins and weeds.

Although by the pole shoe according to DE-GM 89 03 236 the object given there can be achieved and substantially no problems have to be expected as regards a loosening of the securing device, because the pole is slipped onto the journal substantially without force—except for the application of a stroke to the upper end—, this pole shoe or this securing device has the essential drawback, however, that due to the narrow positive-locking surrounding of the journal by the material of the pole or post the pole shoe itself must be anchored exactly vertically in the ground so as to ensure a vertical position of the pole or post held hereby. As for the rest, under certain circumstances also the pole shoe according to DE-GM 89 03 236 may cause problems with respect to a loosening of the securing device disposed at the ground side, if the material of the pole or post is especially hard so that a particular expenditure of energy is necessary to force the toothed ring into the front of the post or pole. By the stroke or strokes by which the pole or post-like object is fixed to the securing device must then be rather powerful so as to obtain the necessary holding forces for the pole or post-like object. Therefore in an unfavorable case— especially in loose soil or sand—the securing device may tend to loosen again by these strokes so that, in the case of stronger forces acting on the object, there is the risk that the object loses its vertical position again or even falls over.

BRIEF SUMMARY OF THE INVENTION

Compared to this, it is the object of the present invention to provide a device for the vertical arrangement of a pole or post-like object on a securing device disposed at the ground end, in which after the securing device disposed at the ground end has been anchored the exactly vertical position of the pole or, post-like object to be fixed hereto can be adjusted subsequently but permanently, wherein the arrangement of the securing device in the ground cannot be changed or loosened during this adjusting operation.

This object is achieved, according to the invention, by the features described in claim 1.

According to the invention, a possibility of vertical positioning or adjustment is provided in a surprisingly simple manner by the fact that the mounting mandrel is substantially thinner than the accommodating bore in the underside of the pole or post-like object. In other words, in contrast to the teaching of DE-GM 89 03 236 in which the material of the pole or post fits around the mandrel or journal in a positive-locking manner, there is considerable play between the journal or mounting mandrel and the bore surrounding the mandrel at the underside of the pole or post. Owing to this play, the pole or post can be mounted on the mounting mandrel such that the pole of post is tilted or inclined within a given angular range, this inclined or tilted position permitting compensation of any positions of the securing device disposed at the ground end which are lopsided relative to the vertical.

Advantageous further developments of the invention constitute the subject-matter of the subclaims.

Preferably a plurality of securing projections extend upwards from the support plate on which the underside of the pole or post-like object is supported, as this is known from DE-GM 89 03 236. Hereby the fixing of the pole or post-like object in any relative position is improved with respect to the device according to the invention.

As an alternative to that, the securing projection extending upwards from the support plate may have the shape of a closed circumferential ring. Hereby the same advantages can be obtained as with the configuration in which a plurality of individual securing projections is provided.

The at least one securing projection is preferably bevelled in a blade-like manner at its free upper side. In this way, the at least one securing projection can penetrate the material of the pole or post-like object. If the blade-like bevelling extends toward the longitudinal axis of the device according to the invention, the risk of bursting or tearing up the material of the pole or post-like object when the at least one securing projection penetrates is minimized.

In a preferred embodiment that mounting mandrel has a tubular shape and is likewise blade-like bevelled at its upper circumferential edge. Hereby not only at least one securing projection digs into the material of the pole or post-like object, but the mounting mandrel, too, penetrates the material of the object at the front wall of the accommodating bore.

The mounting mandrel may have at its upper end portion a through bore extending substantially horizontally through which a pin having a dimension smaller than specified passes. The pin extends to fit exactly in a transverse bore which is formed in the pole or post-like object in true alignment with the through bore in the mounting mandrel. This measure constitutes a protection against removal or detachment such that the pole or post-like object can no longer be easily removed from the device according to the invention by tensile forces directed vertically upwards. Moreover, this securing possibility offers the advantage that even high posts to whose upper ends strokes cannot or can applied only with difficulties due to their vertical extension can be safely clamped. Also in the case of poles or posts for which no striking or driving tool can/must be used due to particular requirements (e.g. to prevent the upper end from splintering or indenting by a striking tool) this securing possibility is especially advantageous. As the pin passing through the through bore in the mounting mandrel has a dimension smaller than specified, this pin does not impede possibly necessary tilting movements of the pole or post-like object for the vertical arrangement thereof.

The pin is preferably a setscrew which is screwed in the transverse bore in the pole or post-like object. Hereby the pin can only be loosened by an appropriate tool so that an increased connecting safety is ensured.

Preferably the support plate can be vertically adjusted along the mounting mandrel. This entails the advantage that at first the relative length of the mounting mandrel can be exactly adapted to the accommodating bore introduced into the pole or post-like object. Furthermore, hereby the pole or post-like object can be braced at the device according to the invention—in particular in connection with the embodiment including the horizontally extending pin. In accordance with a preferred embodiment, the support plate is vertically adjusted in that the support plate rests on a base plate which, in turn, is in threaded engagement with the outer periphery of the mounting mandrel. By a rotation of the base plate at the thread of the mounting mandrel the base plate also moves vertically up- or downwards and accordingly entrains the support plate.

In accordance with another preferred embodiment, the mounting mandrel may comprise two coaxial tubular sections, the outer tubular section being vertically movable with respect to the inner tubular section and, in the case of a vertical upwards movement of the outer tubular section, the same is horizontally or radially extended in its upper end portion. This enables that the mounting mandrel digs inside the accommodating bore of the pole or post-like object so that a protection against removal or detachment is ensured. The outer tubular section preferably has at its upper end portion a plurality of deformable tongues which, in the case of a vertical upward displacement of the outer tubular section, stop at fixed counter-profiles of the inner tubular section and are horizontally/radially bent by them. This represents another preferred embodiment of the present invention, because hereby a reliable protection against removal or detachment is ensured by simple constructional means.

Moreover, according to a configuration of the invention, the support plate can be designed integrally with the securing device. This configuration has an especially simple structure and handling as any movable parts are missing.

If, in accordance with another configuration, the support plate is a component separate from the securing device which can be fastened to the lower front of the pole or post-like object and which makes a frictional and/or positive connection with at least a partial area of the outer periphery of the mounting mandrel, when the mounting mandrel is inserted in the accommodating bore in the underside of the pole or post-like object, no strong stroke or strokes has/have to be applied to the upper end of the pole or post-like object to fix the underside or the front of the pole or post-like object on the support plate and on the at least one securing projection thereof, resp., in order to further drive, in addition to driving the upper end of the mounting mandrel into the bottom of the accommodating bore, the at least one securing projection into the front of the pole or post-like object. Thus the effort is substantially reduced and the forces acting on the securing device disposed at the ground end when fixing the pole or post-like object are thus likewise reduced as well as, consequently, possible dangers of loosening. Hereby a possibility of vertically positioning or adjusting the pole or post-like object is provided in a simple way, the risk that the anchoring device disposed in the ground is loosened when fixing this object being avoided.

In the last-mentioned embodiment the support plate preferably comprises a central opening the circumferential edge of which is in frictional and/or positive-locking contact with at least a partial area of the outer periphery of the mounting mandrel. This is an embodiment of the support plate which is easy to manufacture but can be handled in practice with a minimum effort to fix the same to the mounting mandrel.

The opening may have a polygonal or round cross-section, depending on the cross-section of the mounting mandrel and the possibly existing requirements. However, in practice a round cross-section will probably turn out particularly advantageous regarding the costs and efforts of manufacture both for the mounting mandrel and the accommodating bore in the underside of the pole or post-like object and for the manufacture of the opening in the support plate itself.

The inside diameter of the opening is at most equal to, but preferably smaller than the outside diameter of the mounting mandrel. Hereby and especially when, according to another preferred embodiment, the opening in the support plate is surrounded by a plurality of resilient tongues, the opening of the support plate is automatically anchored to the mounting mandrel.

This locking effect can be intensified and thus further improved by the fact that at least a partial area of the outer periphery of the mounting mandrel has a knurl. Especially in combination with the preferred embodiment that the opening in the support plate is surrounded by a plurality of resilient tongues, whereby the inside diameter of the opening is furthermore smaller than the outside diameter of the mounting mandrel, a reliable fixing of the position and especially a protection against distortion of the attached pole or post-like object is brought about by the fact that the points of the retaining tongues penetrate the knurls provided at the mounting mandrel.

BRIEF DESCRIPTION OF THE SEVERAL VIEWS OF THE DRAWINGS

Further details, aspects and advantages of the present invention are resulting from the following description of several embodiments by way of the figures, where.

DETAILED DESCRIPTION OF THE DRAWINGS

The following description of preferred embodiments of the present invention has to be considered as purely illustrating and exemplary; the representation of the figures and the corresponding description shall not be understood to be restricting.

Figure 1:
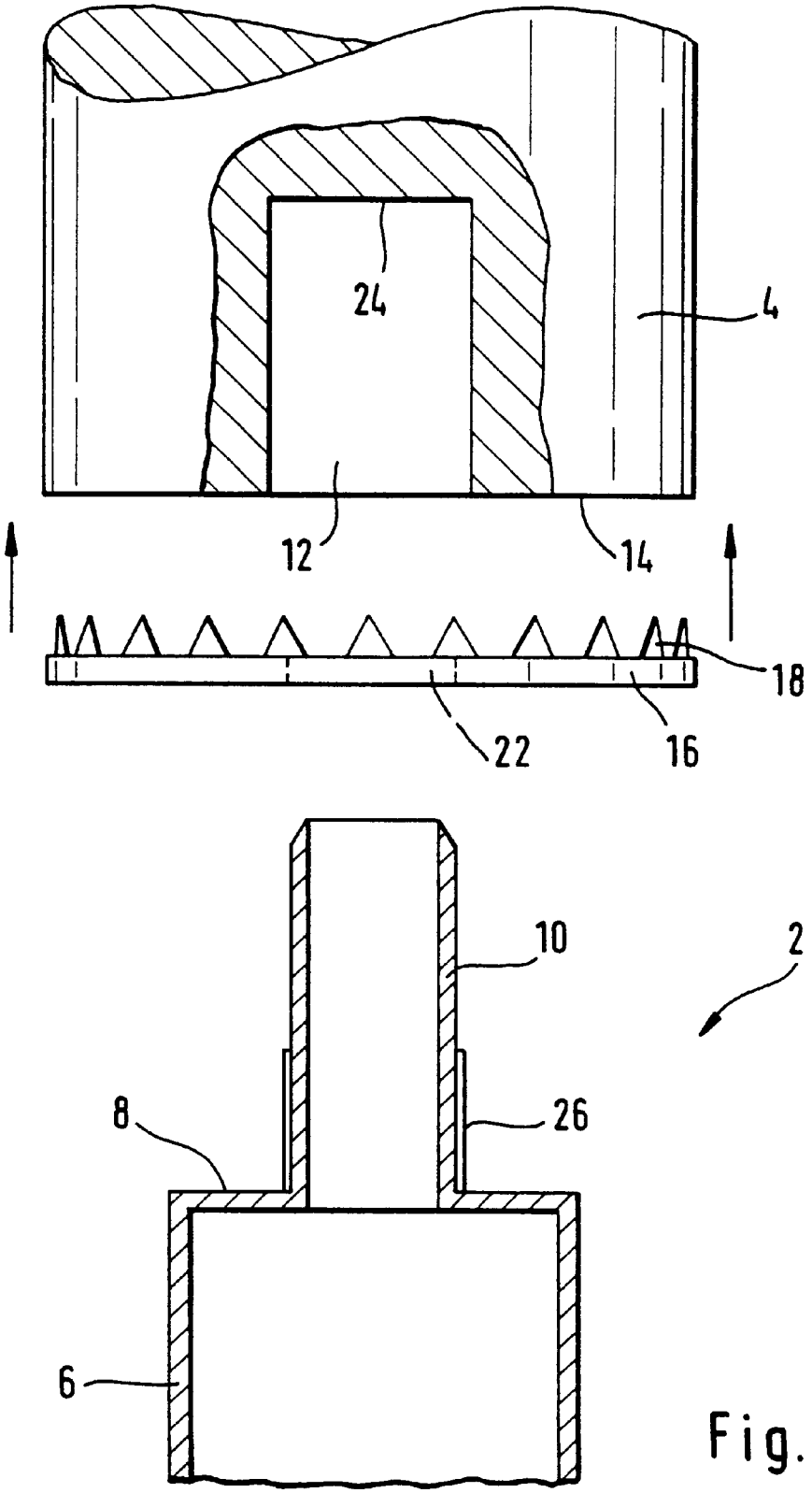
FIG. 1 is a disassembled view of an embodiment of the present invention in the dismounted state.

FIG. 1 shows a first embodiment of the present invention for the vertical arrangement of a pole or post-like object (in the following referred to as "pole") on a securing device disposed at the ground end.

Figure 2:
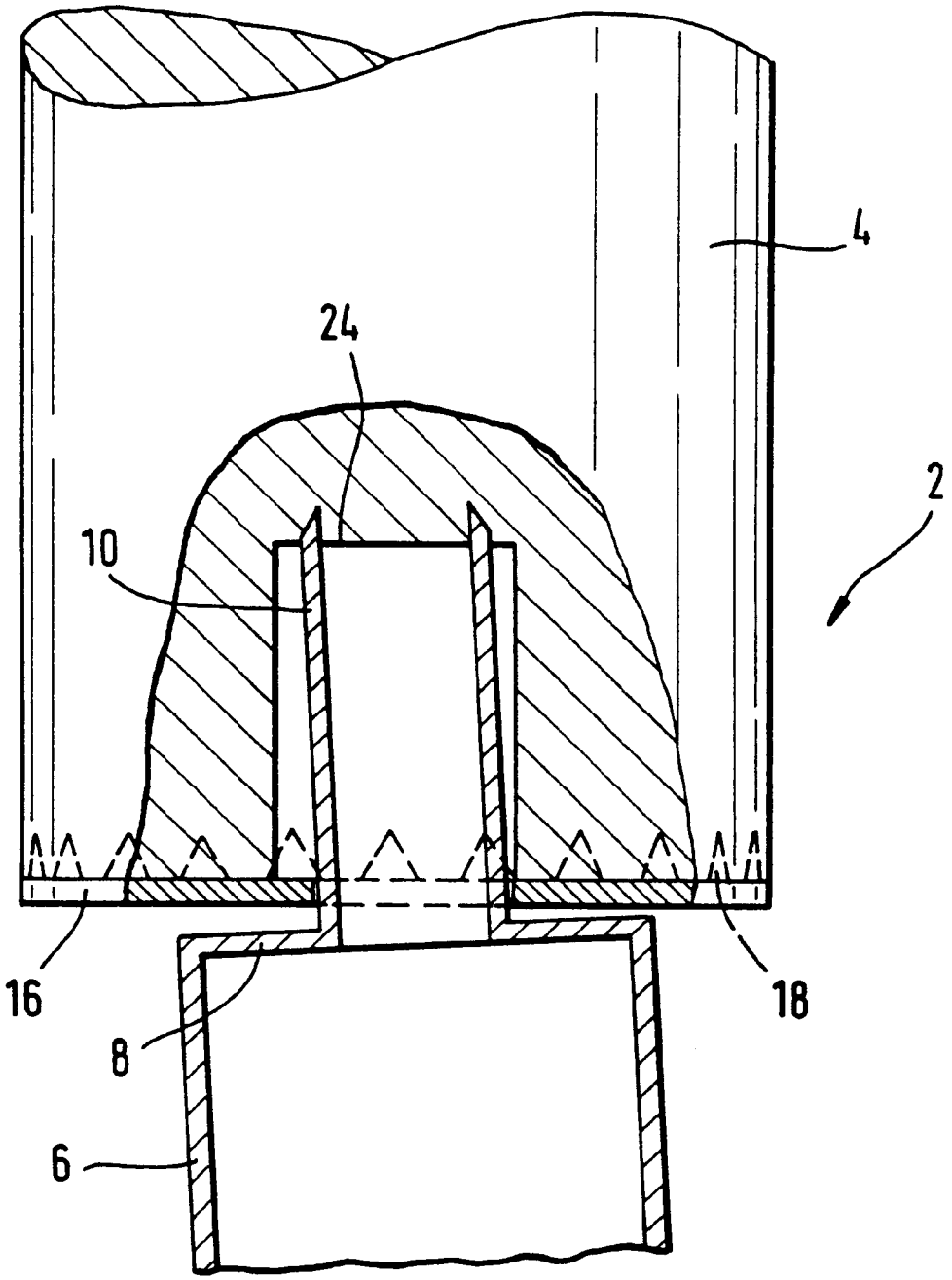
FIG. 2 is a view corresponding to FIG. 1 in the assembled state.

The FIGS. 1 and 2 represent an embodiment of a device 2 according to the invention which serves for the vertical arrangement of a pole 4 on a securing device 6 adapted to be anchored in the ground, for example. The securing device 6 can be dug into the ground or imbedded in concrete or can be screwed into the ground preferably like a corkscrew. A particularly preferred embodiment of the securing device 6 is described in DE-GM 93 13 258 of the same applicant. Herewith reference is fully made to the content of disclosure of that document.

In the embodiment of the device 2 illustrated in FIGS. 1 and 2 the device comprises at the upper free end of the securing device 6 a stepped portion or step 8 centrally supporting a tubular mounting mandrel 10. As one can best take from FIG. 2—the outside diameter of the mounting mandrel 10 is definitely smaller than the inside diameter of an accommodating or blind bore 12 formed at the lower free end of the pole 4. The depth of the bore 12 is preferably smaller than the height of the mounting mandrel 10 in this case.

Figure 3:
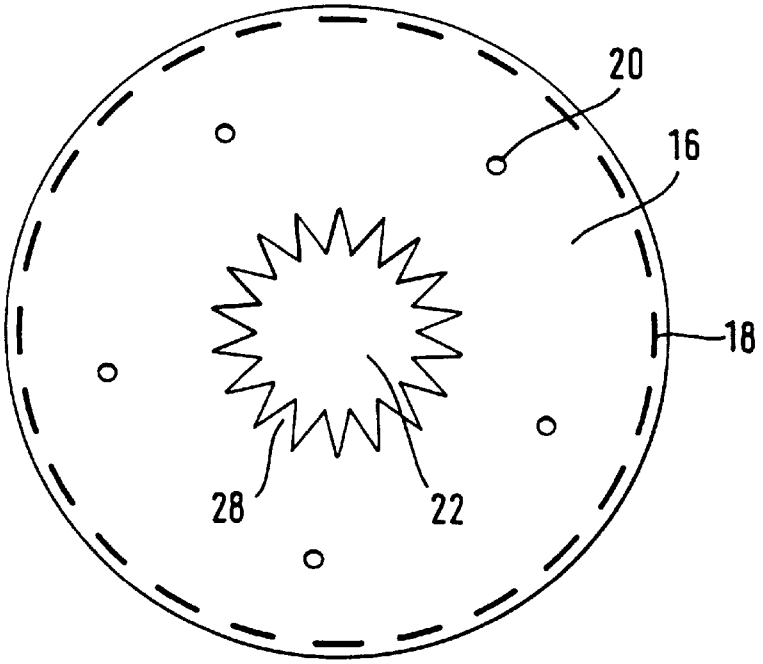
FIG. 3 is a top view of an embodiment of a support plate.
Figure 4:
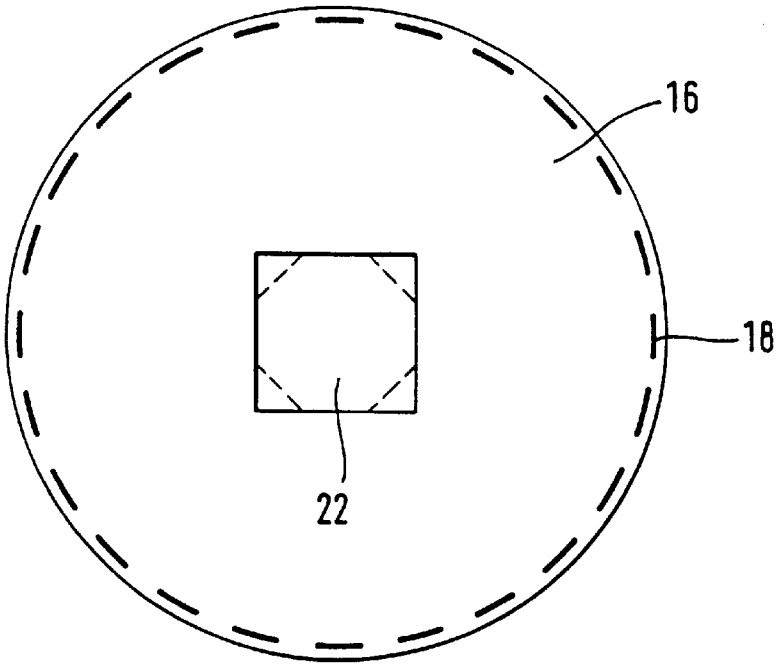
FIG. 4 is a view corresponding to FIG. 3 of another embodiment of a support plate.

A support plate 16 can be disposed between the step 8 and a front 14 of the pole 4 where the bore 12 is introduced. The support plate is adapted as to its shape and surface to the shape and surface of the front 14, i.e. it is usually circular as shown in FIGS. 3 and 4. At least one, preferably several securing projections 18 extend upwards from the upper side of the support plate 16 in the direction of the front 14. In this case, according to the drawing, a plurality of securing projections 18 in the form of prongs, tines or spikes may extend upwards from the support plate 16, or else the securing projection 18 has the shape of a closed circumferential ring surrounding the periphery of the support plate 16.

The securing projection(s) 18 is/are preferably blade-like bevelled at its/their upper free end(s), the bevelling extending toward the central longitudinal axis of the device 2. In the same way, the upper free edge of the mounting mandrel 10 is blade-like bevelled. If the blade-like bevellings extend toward the longitudinal axis of the device 2 according to the invention, the risk of a bursting or cracking open of the material of the pole 4 while the projections are penetrating is minimized.

The fixing of the pole 4 on the device 2 is effected such that at first the securing device 6 is anchored in the ground, for instance by screwing it in or imbedding it in concrete.

After that the support plate 16 is put on the underside or front 14 of the pole 4 and connected with the front 14. To this effect, the securing projections 18 which penetrate the material of the pole 4, when one or more hammer strokes are applied to the support plate 16, are provided at the support plate 16. Alternatively to the embodiment of the securing projections 18 shown in the FIGS. 1 and 2 in the form of prong or tine-like points penetrating the material of the pole 4, the securing projection 18 may—as mentioned in the foregoing already—have the shape of a closed circumferential ring surrounding the periphery of the support plate 16. As another alternative, according to FIG. 3 a plurality of bores 20 which permit nails or tacker clips or the like to penetrate the material of the support plate 16 with the aid of such securing means on the front of the pole 4 may be provided in the support plate 16 so that the support plate 16 can be fastened. In any case the support plate 16 has a central opening 22 which is formed in the support plate 16 such that it is substantially in alignment with the bore 12 in the lower end portion of the pole 4 after the support plate 16 has been attached to the front 14.

After attaching the support plate 16 the pole 4 according to FIG. 1 is mounted on the securing device 6 from the top, the mounting mandrel 10 being introduced in the bore 12 through the opening 22 by a predetermined force. In this case the pole 4 rests on the upper edge of the mounting mandrel 10 with a base 24 of the bore 12. According to FIG. 2, then the pole 4 is tilted—preferably with the aid of a plumb line or a water level—in such a way that possible inclinations of the securing device 6 are compensated and the pole 4 is arranged exactly vertically. The pole 4 is enabled to be tilted with respect to the securing device 6 by the fact that the outside diameter of the mounting mandrel 10 is definitely smaller, according to the invention, than the inside diameter of the bore 12 so that the mandrel 10 may extend obliquely or out-of-perpendicular inside the bore 12, as illustrated in FIG. 2. As soon as the pole 4 is arranged exactly vertically, one or several strokes are applied to the upper free end of the pole 4 by a hammer or another suitable driving tool so that the upper circumferential edge of the mounting mandrel 10 digs into the base 24 of the bore 12 and thus, according to FIG. 2, the pole 4 is held with respect to the securing device 6.

Furthermore, interposing the support plate 16 to the mounting mandrel 10, the pole 4 is held closely to the step 8, wherein the support plate 16 rests completely or partly—depending on the degree of tilting of the pole 4—on the step 8.

The support plate 16 mounted on the mounting mandrel 10 in that the inside diameter of the opening 22 is at most equal to, preferably smaller than the outside diameter of the mounting mandrel 10. Hereby a frictional and/or positive-locking contact or connection of the support plate 16 with at least a partial area of the outer periphery of the mounting mandrel 10 is effected so that the position of the pole 4 is immovably fixed with respect to the securing device 6. This frictional and/or positive-locking connection of the support plate 16 and the opening 22 with the mounting mandrel 10 can be intensified by the fact that at least a partial area of the outer periphery of the mounting mandrel 10 is provided with a knurl 26. The opening 22 in the support plate 16 may, according to FIG. 3, also be surrounded by a plurality of resilient tongues 28 which elastically deform (i.e. bend upwards) when the pole 4 is slipped onto the mounting mandrel 10, wherein the mounting mandrel 10 penetrates the opening 22, so that especially in connection with the knurl 26 the support plate 16 and thus the pole 4 is safely fixed with respect to the securing device 6. Due to the flexibility of the tongues 28, the pole 4 can be tilted within a wider range with respect to the mounting mandrel 10 and thus the securing device 6.

By the blade-like bevelling of the upper circumferential edge of the mounting mandrel 10 this portion can easily penetrate the material of the pole 4. As furthermore the blade-like bevelling is effected continuously toward the central longitudinal axis of the device 2, no outwardly directed extending or bursting forces are exerted on the material of the pole 4 so that the entire lower portion of the pole 4—with the exception of the penetrated securing projection(s) 18—remains unimpaired and thus less susceptible to atmospheric influences, vermins, weeds or the like.

The cross-section of the opening 22 depends substantially on the cross-section of the mounting mandrel 10. That is, when the mounting mandrel 10 is tubular having a circular cross-section, the opening 22 equally has a preferably round cross-section, as shown in FIG. 3, wherein the resilient tongues 28 are possibly still provided. Just as well the opening 22 may have a square (FIG. 4: continuous lines) or a polygonal (FIG. 4: broken lines) cross-section. A polygonal cross-section of the opening 22 may also be used with a round cross-section of the mounting mandrel 10. Even in the case of a square or polygonal cross-section of the opening 22 resilient retaining tongues may be provided.

Since the support plate 16 is secured to the front 14 of the pole 4 before the pole 4 is slipped onto the mounting mandrel 10 of the securing device 6, the forces required for fixing the pole 4 on the securing device 6 are limited to those forces which are necessary for slipping the pole 4 onto the mounting mandrel 10, the latter passing through the opening which preferably has a dimension smaller than specified, and the forces necessary to press or drive the mandrel 10 into the base 24. So the risk that the securing device 6 can loosen in the ground by forces applied to the pole 4 for securing the same is substantially reduced.

FIGS. 5A to 8 show further embodiments of the present invention for the vertical arrangement of a pole or post-like object on a securing device disposed at the ground end.

In the FIGS. 5A to 8 equal reference numerals denote equal or corresponding parts as in the FIGS. 1 to 3; these parts are not explained once again.

Figure 5B:
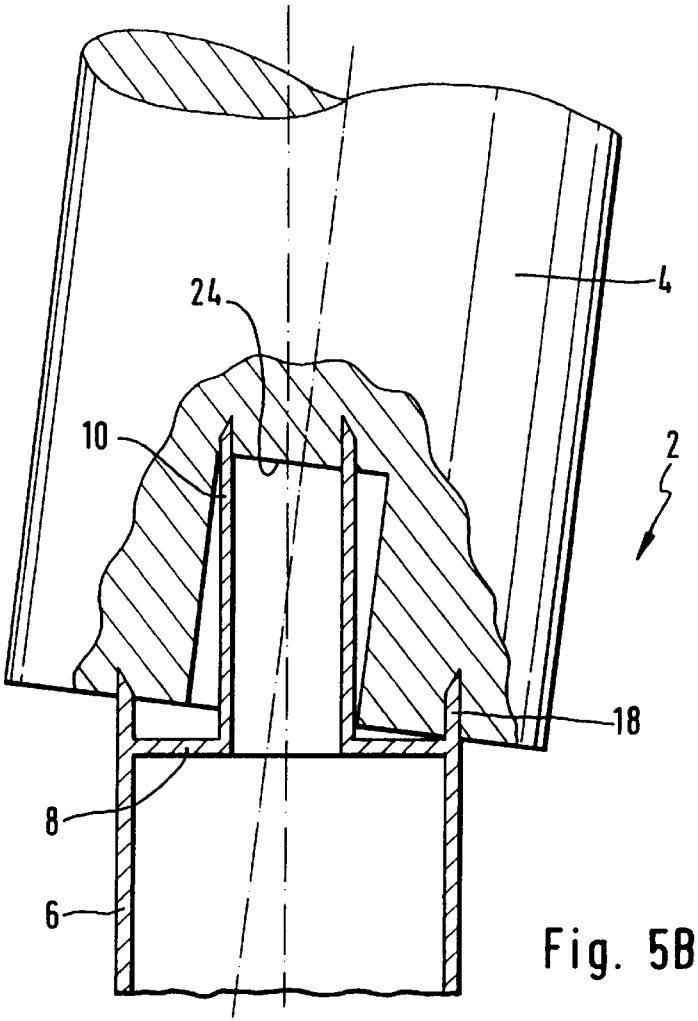
FIGS. 5A and 5B show another embodiment of the present invention.
Figure 5A:
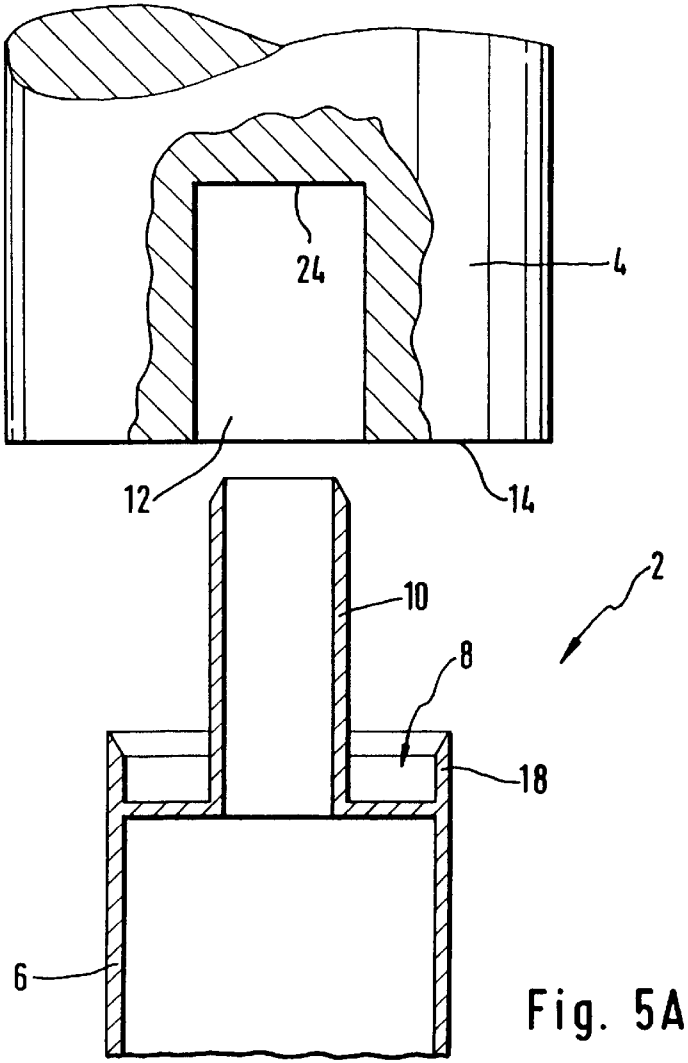

In the configuration of the device 2 represented in FIGS. 5A and 5B this device includes at the upper free end of the securing device 6 the stepped area or step 8 which, in turn, centrally supports the tubular mounting mandrel 10. Here the outside diameter of the mounting mandrel 10 is—as can best be taken from FIG. 5B—definitely or substantially smaller than the inside diameter of the accommodating or blind bore 12. The depth of the bore 12 again is at most equal to, but preferably slightly smaller than the height of the mounting mandrel 10.

At least one securing projection 18 extends upwards radially outwardly from the step or the support plate 8. Here again a plurality of tine or spike-shaped securing projections 18 can extend upwards from the step 8 or else the securing projection 18 has the shape of the closed circumferential ring surrounding the step 8.

In accordance with FIGS. 5A and 5B as in the embodiment of the FIGS. 1 to 3, the securing projection(s) 18 is/are blade-like bevelled at their upper free end, the bevelling extending toward the central longitudinal axis of the device 2. In the same way the upper free edge of the mounting mandrel 10 is bevelled in a blade-like manner.

The pole 4 is secured on the device 2 such that at first the securing device 6 is again anchored in the ground, for instance by screwing it in or imbedding it in concrete. After that the pole 4 is mounted from the top on the securing device 6 according to FIG. 5A, the mounting mandrel 10 being introduced in the bore 12. The pole 4 rests with its lower surface or front 14 on the securing projection(s) 18 and the front or base 24 of the bore 12 rests on the upper edge of the mounting mandrel 10. Then, according to FIG. 5B, the pole is tilted—preferably with the aid of a plumber line or a water level—in such a way that possible inclinations of the securing device 6 are compensated and the pole 4 has an exactly vertical position. This tilting of the pole 4 with respect to the securing device 6 is permitted by the fact that the outside diameter of the mounting mandrel 10 is substantially smaller than the inside diameter of the bore 12 so that the mandrel 10 can extend obliquely or out-of-perpendicular inside the bore 12, as shown in FIG. 5B. As soon as the pole 4 is positioned exactly vertically, one or several strong strokes are applied to the upper free end of the pole 4 by a hammer or another suitable driving tool so that the securing projection(s) 18 penetrate(s) the lower area 14 of the pole 4 and, moreover, the upper circumferential edge of the mounting mandrel 10 penetrates the front 24 of the bore 12 so that, according to FIG. 5B, the pole 4 is held with respect to the securing device 6. Furthermore, the pole 4 is supported with part of its lower surface 16 on the step 8 which thus corresponds in its function together with the securing projection(s) 18 to the supporting plate 16 of the FIGS. 1 to 3.

The embodiment according to FIGS. 5A and 5B is sufficient, whenever during later use no upwardly directed tensile forces are applied, i.e. for instance in the case of supporting beams or girders absorbing pure forces of pressure. If, however, such upwardly directed tensile forces have to be expected, preferably one of the embodiments in accordance with the FIGS. 1 to 3 or 6A to 8 is used.

In the FIGS. 6A to 8 again equal reference numerals denote equal or corresponding parts to those in the FIGS. 5A and 5B.

Figure 6B:
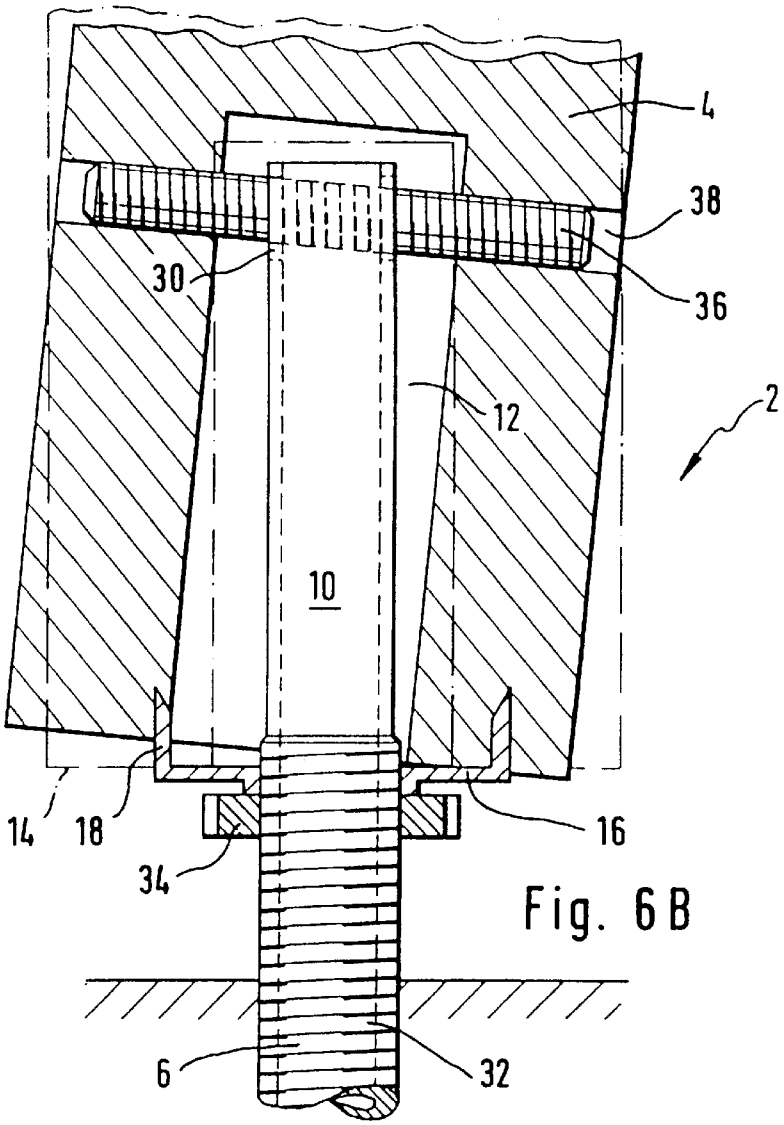
FIGS. 6A and 6B show another embodiment of the present invention.
Figure 6A:
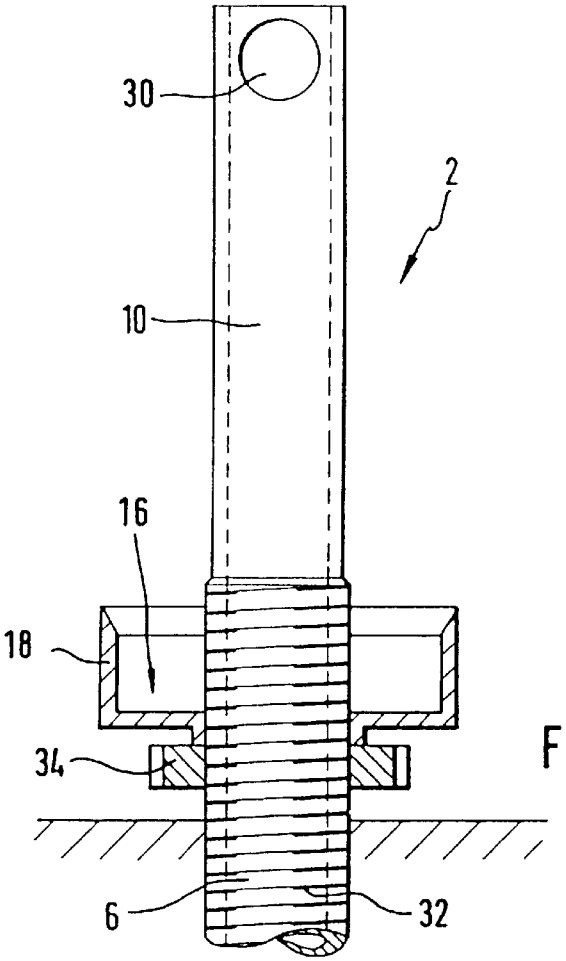

According to FIG. 6A, the device 2 there again comprises the mounting mandrel 10 which is preferably formed integrally with the securing device. The mounting mandrel 10 includes a substantially horizontally extending through bore 30 at its upper free end. Immediately adjacent to the mounting mandrel 10 a male thread 32 which is engaged with a female thread provided on a base plate 34 is formed at the securing device 6. The support plate 16 which is freely movable along the male thread 32, i.e. is not engaged with the male thread 32, rests on the upper side of the base plate 34. From the support plate 16 again the securing projection(s) 18 extend(s) upwards.

In accordance with FIG. 6B, a horizontally extending pin 36 which is inserted in a horizontally extending bore 38 in the pole 4 passes the through bore 30. The pin 36 has a considerably smaller dimension than specified vis-à-vis the through bore 30 so that, according to FIG. 6B, the pin 36 and thus the pole 4 can be tilted with respect to the securing device 6, wherein, due to the smaller dimension of the pin 36, the same can extend obliquely in the through bore 30.

Preferably the pin 36 is inserted to fit exactly in the bore 38 of the pole 4, in a particularly preferred embodiment it is screwed in so that the pin 36 is safely held in the pole 4.

For fastening the pole 4 on the securing device 6 at first the pole 4 is slipped from the top onto the mounting mandrel 10 and subsequently it is secured by means of the pin 36 in the bore 30. Thus the pin 36 prevents the pole 4 from being removed or detached toward the top. After that the base plate 34 is rotated so that in the FIGS. 6A and 6B it is moved upwards along the male thread 32 and hereby entrains the support plate 16. While screwing up the base plate 34 and thus the support plate 16, the securing projection(s) 18 penetrate(s) the lower face 14 of the pole 4. According to FIG. 6B, the pole 4 may possibly be tilted with respect to the securing device 6 before the base plate 34 is screwed up in order to be able to compensate possible inclinations of the securing device 6. The pole 4 is braced at the securing device 6 in any desired position by the base plate 34 and thus by the support plate 16, on the one hand, and, on the other hand, by the operating connection serving as a protection against removal or detachment between the pin 36 and the through bore 30.

Figure 7:
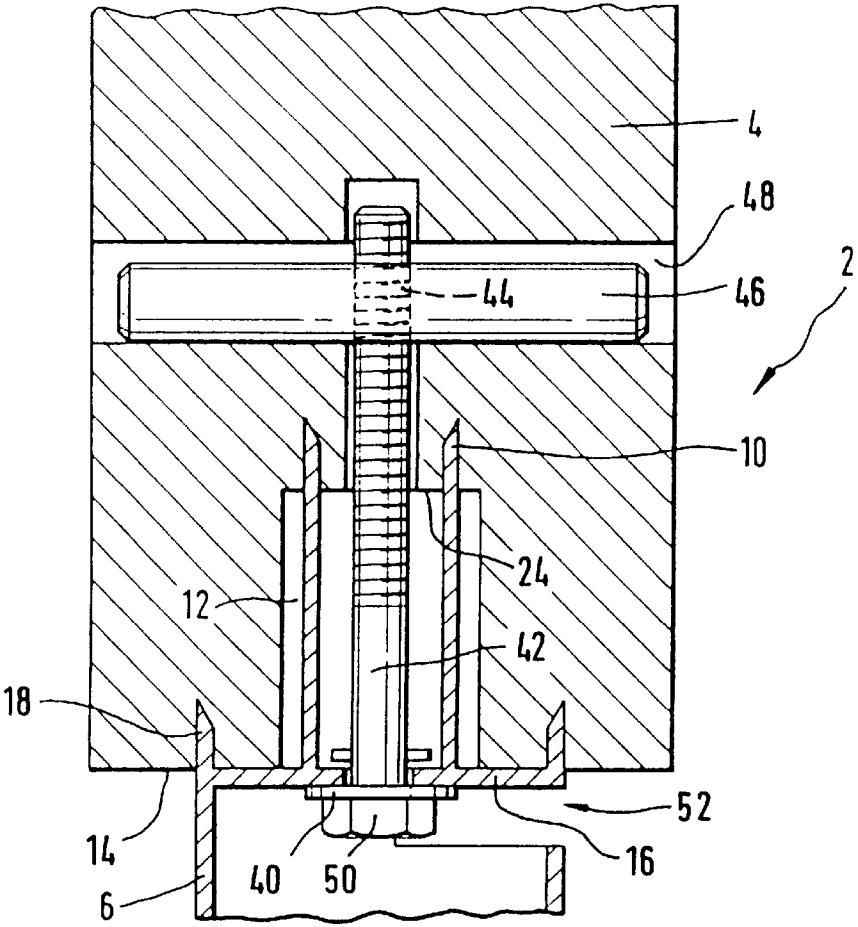
FIG. 7 shows another embodiment of the present invention.

FIG. 7 shows a modified embodiment of that shown in the FIGS. 6A and 6B.

According to FIG. 7 a bolt 42 extends upwards from the support plate 16 into the material of the pole 4 with a washer 40 being interposed. The threaded portion of the bolt 42 is engaged with a female thread 44 formed in a pin 46 which extends substantially horizontally in a bore 48. According to FIG. 7, the pin 46 has a dimension smaller than specified vis-à-vis the bore 48. A hexagon head 50 of the bolt 42 is accessible via a recess 52 in the securing device 6, the recess 52 extending over a certain amount of the periphery, for instance 90°. The bolt 42 is rotated by an open-end spanner or a similar tool which is attached to the bolt head 50 via the recess 52. As one can take directly from FIG. 7, when the bolt 42 is tightened the threaded portion of the bolt 42 is moved upwards relative to the pin 46 and this upward movement of the bolt is converted into a downward movement of the pole 4 in FIG. 7 due to the arrangement of the pin 46 in the bore 48 so that the securing projection(s) 18 penetrate(s) the lower face of the pole 4 and the tubular mounting mandrel 10 penetrates the front face 24 of the bore 12 in the pole 4 so that the pole 4 is fixed with respect to the securing device 6.

Figure 8:
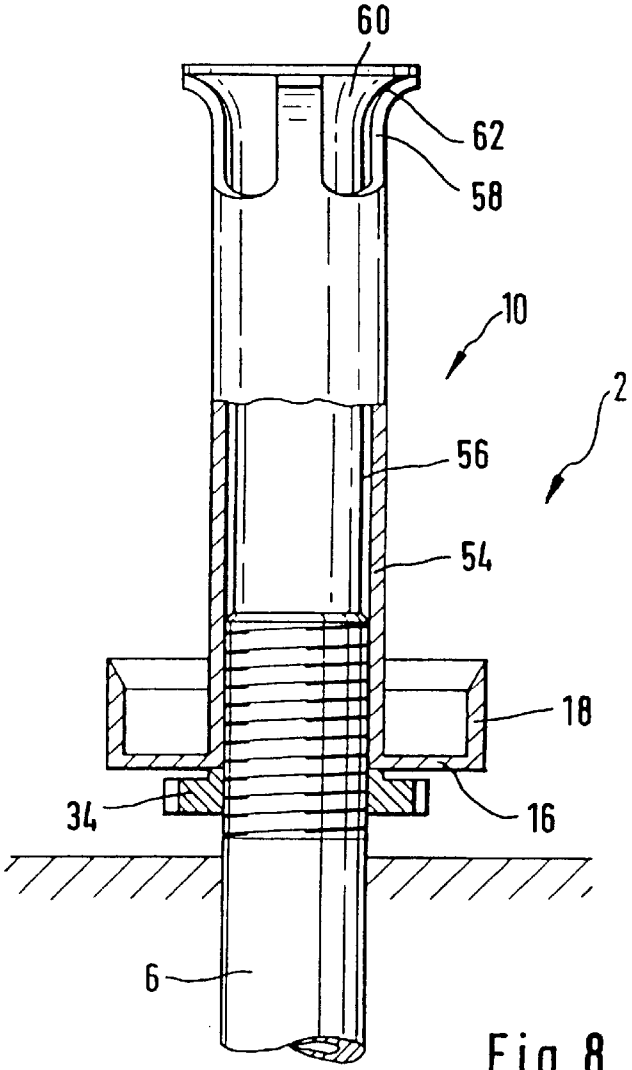
FIG. 8 shows another embodiment of the present invention.

FIG. 8 shows a further embodiment of the present invention. The embodiment according to FIG. 8 distinguishes in particular by the fact that the mounting mandrel 10 consists of two coaxial tubular sections, namely an outer tubular section 54 and an inner tubular section 56. The outer tubular section 54 is preferably formed at its lower end portion integrally with the support plate 16 including the securing projection 18 projecting upwards herefrom. The support plate 16 rests, as in the embodiment according to FIGS. 6A and 6B, on the base plate 34 which is engaged with an outer threaded portion at the mounting mandrel 10 and the inner tubular section 56, respectively. At the upper free end portion the inner tubular section 56 is expanded to be funnel-shaped in the way visible from FIG. 8 and the outer tubular section 54 has a plurality of tongues 58. The tongues 58 are formed in that the material of the outer tubular section 54 is provided with a plurality of recesses 60 in the upper free end portion. The conical or funnel-shaped expansion of the inner tubular section 56 forms a correspondingly conical or funnel-shaped counter-face 62 to which the tongues 58 are adjacent.

For securing a pole not represented in FIG. 8 on the device 2 according to the invention in accordance with FIG. 8, the pole is slipped onto the mounting mandrel 10 so that the underside of the pole rests on the blade-like bevelling of the securing projection(s) 18. Then the base plate 34 is rotated—possibly by a suitable tool—upwards on the inner tubular section 56 along the outer threaded portion, whereby the support plate 16 in FIG. 8 is likewise moved upwards. This upward movement of the support plate 16 is transmitted via the outer tubular section 54 to the tongues 58 so that the tongues 58 are bent substantially horizontally or radially outwardly by the conical counter-face 62 and penetrate the material of the pole inside of that bore 12. At the same time, the securing projections 18 penetrate the underside of the pole so that the pole is safely supported. Although it is not shown in FIG. 8, it is understood that also in this embodiment the bore in the pole is interfering vis-à-vis the mounting mandrel 10 so that the vertical arrangement can be corrected, if necessary, before finally tightening or clamping the pole.

I claim:

1. A device in combination with a pole (4) having a ground end and a free upper end, the pole (4) to be arranged in a vertical orientation, comprising:

a securing device (6) disposed at the ground end of the pole (4);

a substantially cylindrical, elongated mounting mandrel (10) which projects upwards from the free upper side of the securing device (6) and inserted into an accommodating bore (12) in the underside of the ground end of the pole (4);

a support plate (16) on which the underside of the ground end of the pole (4) rests, wherein at least one securing projection (18) protrudes upwards from the support plate (16) and penetrates the material of the pole (4);

characterized in that the mounting mandrel (10) is substantially thinner than the accommodating bore (12) in the underside of the ground end of the pole (4) such that a play is provided between the outer periphery of the mounting mandrel (10) and the inner area of the accommodating bore (12) seen substantially over the entire axial extension of the mounting mandrel (10) such that said accommodating bore (12) allows angular adjustment of the pole (4) about a horizontal axis.

2. A device according to claim 1, characterized in that a plurality of said securing projections (18) protrude upwards from the support plate (16).

3. A device according to claim 1, characterized in that the at least one securing projection (18) protrudes upwards from the support plate (16) in the form of a closed circumferential ring.

4. A device according to claim 1, characterized in that the at least one securing projection (18) is bevelled on its free upper side.

5. A device according to claim 4, characterized in that the bevelling extends toward a central longitudinal axis of the device (2).

6. A device according to any one of the claims 1 to 5, characterized in that the mounting mandrel (10) is tubular and is bevelled at its upper circumferential edge.

7. A device according to claim 1, characterized in that the mounting mandrel (10) has in its upper end portion a substantially horizontally extending through bore (30) through which a pin (36) having a diameter smaller than the through bore (30) passes, wherein the pin (36) extends to fit exactly in a transverse bore (38) formed in the pole (4) to be in alignment with the through bore (30) provided in the mounting mandrel (10).

8. A device according to claim 7, characterized in that the pin (36) is a threaded pin which is screwed in the transverse bore (38) in the pole (4).

9. A device according to claim 7, characterized in that the support plate (16) is vertically adjustable along the mounting mandrel (10).

10. A device according to claim 9, characterized in that the support plate (16) rests on a base plate (34) which is engaged by threads with the outer periphery of the mounting mandrel (10).

11. A device according to claim 1, characterized in that the mounting mandrel (10) consists of two coaxial tubular sections (54, 56), the outer tubular section (54) being vertically movable with respect to an inner tubular section (56) and, when the outer tubular section (54) is moved vertically upwards, the same is expanded substantially radially in its upper end portion.

12. A device according to claim 11, characterized in that the outer tubular section (54) has at its upper end portion a plurality of deformable tongues (58) which stop at stationary counter-profiles (62) of the inner tubular section (56), when the outer tubular section (54) is moved vertically upwards, and are bent substantially radially outwardly by them.

13. A device according to claim 1, characterized in that the support plate (16) is formed integrally with the securing device (6).

14. A device according to claim 1, characterized in that the support plate (16) is a component which is separate from the securing device (6) and is adapted to be fixed to the underside of the ground end of the pole (4) and which forms a frictional connection with at least a partial area of the outer periphery of the mounting mandrel (10), when the mounting mandrel (10) is inserted into the accommodating bore (12) in the underside of the ground end of the pole or post-like object (4).

15. A device according to claim 14, characterized in that the support plate (16) has a central opening (22) which develops frictional contact with at least a partial area of the outer periphery of the mounting mandrel (10).

16. A device according to claim 15, characterized in that the central opening (22) has a polygonal cross-section.

17. A device according to claim 15, characterized in that the central opening (22) has a round cross-section.

18. A device according to claim 14, characterized in that the internal periphery of the central opening (22) is at most equal to, or preferably smaller than the external diameter of the mounting mandrel (10).

19. A device according to claim 14, characterized in that the central opening (22) in the support plate (16) is surrounded by a plurality of resilient tongues (28).

20. A device according to claim 14, characterized in that the outer periphery of the mounting mandrel (10) has a knurl (26) at least in a partial area.

* * * * *

UNITED STATES PATENT AND TRADEMARK OFFICE
CERTIFICATE OF CORRECTION

PATENT NO : 5,957,424

DATED : September 28, 1999

INVENTOR(S) : Klaus Krinner

It is certified that error appears in the above-identified patent and that said Letters Patent is hereby corrected as shown below:

On the title page, item [75],

The address of the inventor should read [Blumenthal 9] Blumenthal 19

The Foreign Application Priority data should read:

[Aug. 22, 1996 [DE] Germany 296 06 034 U]

Apr. 1, 1996 [DE] Germany 296 06 034.8

Signed and Sealed this

Twenty-sixth Day of September, 2000

*Attest:*

*Attesting Officer*

Q. TODD DICKINSON

*Director of Patents and Trademarks*